US007017666B1

(12) United States Patent
Allen et al.

(10) Patent No.: US 7,017,666 B1
(45) **Date of Patent: *Mar. 28, 2006**

(54) SMOOTH SLEEVES FOR DRAG AND VIV REDUCTION OF CYLINDRICAL STRUCTURES

(75) Inventors: Donald Wayne Allen, Houston, TX (US); Dean Leroy Henning, Needville, TX (US); David Wayne McMillan, Deer Park, TX (US); Richard Bruce McDaniel, Houston, TX (US); Kenneth Dupal, Mandeville, LA (US)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/625,893

(22) Filed: Jul. 26, 2000

Related U.S. Application Data

(60) Provisional application No. 60/154,289, filed on Sep. 16, 1999.

(51) Int. Cl.
*E21B 17/01* (2006.01)
*E21B 31/00* (2006.01)
*E02D 5/56* (2006.01)

(52) U.S. Cl. ..... 166/367; 166/350; 405/211; 405/212; 405/216; 114/243

(58) Field of Classification Search ..... 114/243; 405/211, 212, 216, 195.1; 166/367, 350
See application file for complete search history.

(56) References Cited

U.S. PATENT DOCUMENTS 3,581,449 A * 6/1971 Huber
4,073,983 A * 2/1978 Van Cleave
4,398,487 A * 8/1983 Ortloff et al.
4,470,722 A * 9/1984 Gregory
5,410,979 A 5/1995 Allen et al. ..... 114/243
5,421,413 A 6/1995 Allen et al. ..... 166/335
5,875,728 A 3/1999 Ayers et al. ..... 114/264
6,048,136 A * 4/2000 Denison et al.
6,092,483 A 7/2000 Allen et al. ..... 114/264
6,148,751 A * 11/2000 Brown et al.
6,179,524 B1 1/2001 Allen et al. ..... 405/211
6,196,768 B1 3/2001 Allen et al. ..... 405/224
6,206,614 B1 * 3/2001 Blevins et al.
6,223,672 B1 5/2001 Allen et al. ..... 114/243
6,227,137 B1 5/2001 Allen et al. ..... 114/264
6,263,824 B1 7/2001 Balint et al. ..... 114/264
6,309,141 B1 10/2001 Cox et al. ..... 405/224
6,551,029 B1 4/2003 Shu et al. ..... 405/211
6,561,734 B1 5/2003 Allen et al. ..... 405/216

(Continued)

FOREIGN PATENT DOCUMENTS

GB 2 299 822 A 10/1996

(Continued)

OTHER PUBLICATIONS

Graham, Flow Past a Cylinder, 4 pages, downloaded from http://astron.berkeley.edu/~jrg/ay202/lectures/node18.html.*

(Continued)

*Primary Examiner*—Katherine Mitchell
(74) *Attorney, Agent, or Firm*—William E. Hickman

(57) ABSTRACT

A method for controlling drag and vortex induced vibration in a substantially cylindrical element by providing an ultra-smooth surface about the cylindrical element. The system for controlling drag and vortex induced vibration utilizes a substantially cylindrical marine element having an ultra-smooth effective surface.

22 Claims, 8 Drawing Sheets

U.S. PATENT DOCUMENTS

| | | | | |
|---|---|---|---|---|
| 6,565,287 | B1 | 5/2003 | McMillian et al. | 405/211.1 |
| 6,571,878 | B1 * | 6/2003 | Mc Daniel et al. | 166/367 |
| 6,644,894 | B1 | 11/2003 | Shu et al. | 405/211 |
| 6,685,394 | B1 | 2/2004 | Allen et al. | 405/211 |
| 6,695,539 | B1 | 2/2004 | McMillan et al. | 405/191 |
| 6,702,026 | B1 * | 3/2004 | Allen et al. | 166/367 |
| 6,886,487 | B1 | 5/2005 | Fischer, III | 114/230.1 |
| 2003/0213113 | A1 | 11/2003 | McMillan et al. | 29/281.1 |
| 2004/0175240 | A1 | 9/2004 | McMillan et al. | 405/211 |

FOREIGN PATENT DOCUMENTS

GB 2 315 797 A 11/1998

OTHER PUBLICATIONS

Mikolaitis, University of Florida, Friction Factor Calculator, 1 page, downloaded from http://grumpy.aero.ufl.edu/gasdynamics/colebrook10.html.*

Vortex Shedding behind a circular cylinder, 4 pages, downloaded from http://www.sintef.no/nhl/vass/cylinder.html.*

Sellens, MECH 441, Losses in Piping, 4 pages, Revised Sep. 9, 1996, downloaded from http://sellensr.me.queensu.ca/sellens/441/losses.htm.*

Robertson and Crowe, Engineering Fluid Mechanics, 5th Ed., Houghton Mifflin Co, © 1993, chapter 10, pp. 428-429.*

Robertson/Crowe Engineering Fluid Mechanics, 5th Edition, Relative Roughness and Resisitance coefficients, pp. 428-429, © 1993.*

Harris et al., Harris' Shock and Vibration Handbook, 5th Edition, Mc Graw Hill, © 2002 and 1996, Chapter 29.*

Oil and Gas INternational, Mitigating vortx-induced vibration, from www.oilandgasinternational.com/departments/technical_reports/vortex_induced.html, 3 pages, May 12, 2001.*

Vortex-Induced Vibration Tests of a Flexible Smooth Cylinder at Supercritica Reynolds Numbers, by D. W. Allen and D. L. Henning, Shell E&P Technology Company, Houston, Texas.

Vortex-Induced Vibration Suppression of Cylindrical Structures, D. W. Allen, Apr., 1994, pp. 1-51.

* cited by examiner

SMOOTH SLEEVES FOR DRAG AND VIV REDUCTION OF CYLINDRICAL STRUCTURES

This application claims the benefit of U.S. Provisional Application No. 60/154,289 filed Sep. 16, 1999, the entire disclosure of which is hereby incorporated by reference.

BACKGROUND

The present invention relates to a method and apparatus for reducing drag and vortex-induced-vibrations ('VIV') and, more particularly, reducing VIV and drag to cylindrical elements in marine environments.

Production of oil and gas from offshore fields has created many unique engineering challenges. One set of such challenges involves the use of cylindrical marine elements that are susceptible to large drag and vibrations when in the presence of significant ocean currents. Such marine elements are used in a variety of applications, including, e.g., subsea pipelines; drilling, production, import and export risers; tendons for tension leg platforms; legs for traditional fixed and for compliant platforms; space-frame members for platforms; cables; umbilicals; and other mooring elements for deepwater platforms; and, although not conventionally thought of as such, the hull and/or column structure for tension leg platforms (TLPs) or for spar type structures. These currents cause drag on the element and cause vortexes to shed from the sides, inducing drag forces and vibrations that can lead to the failure of the marine elements. Large drag forces can result in increased mooring or station keeping costs as well as the imposition of constraints on what kinds of systems are workable in a current environment (due to stress limitations, top angle limitation while drilling, etc.). Large vibrations (primarily vortex-induced vibrations) cause dynamic motions that, in turn, cause premature fatigue failures of structural members. In addition, large vibrations typically cause substantial increases in mean and dynamic drag forces. Finally, the presence of ocean currents can cause interference between adjacent structures.

One solution to the above set of issues is to use helical strakes. However, helical strakes are not very effective at reducing drag, and those are rarely used if drag reduction is important (e.g. drilling risers). Another solution which, if properly designed, can have all the positive benefits of helical strakes and can also reduce drag, is the use of fairings. However, there are many instances where the use of fairings is either impractical or uneconomical. An example is the reduction of drag and VIV for a drilling riser, where fairings can be very difficult to handle and therefore impose large usage costs in terms of lost time due to installation. For instance, fairings will not fit through a drilling rig rotary in order to allow installation above the rotary at a substantially reduced cost. Fairings also must typically be quite large and expensive to minimize drag coefficients. One of these challenges is dealing with effects of currents on fixed cylindrical marine elements.

SUMMARY OF THE INVENTION

The present invention is a method of controlling drag and vortex induced vibration in a substantially cylindrical element by providing an ultra-smooth surface about the cylindrical element. Another aspect of the present invention is a system for controlling drag and vortex induced vibration in which a substantially cylindrical marine element has an ultra-smooth effective surface.

BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in which.

A DETAILED DESCRIPTION OF ILLUSTRATIVE EMBODIMENTS

Figure 1:
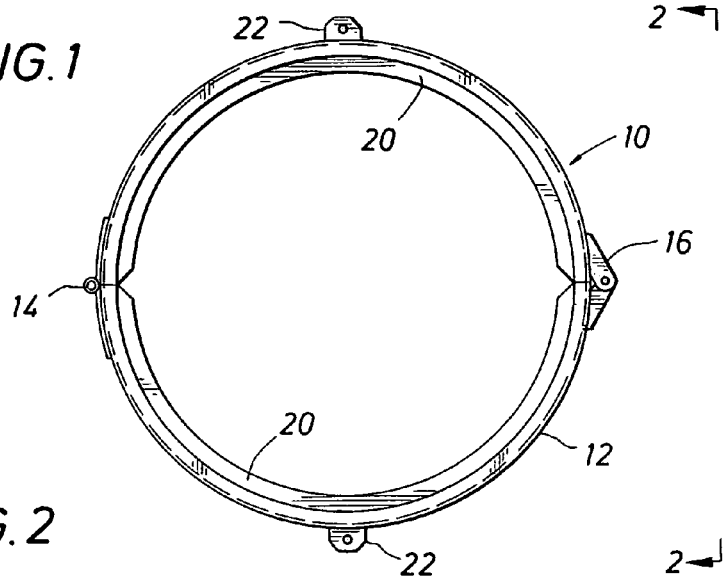
FIG. 1 is a top elevational view of one embodiment of the invention formed sleeve.
Figure 2:
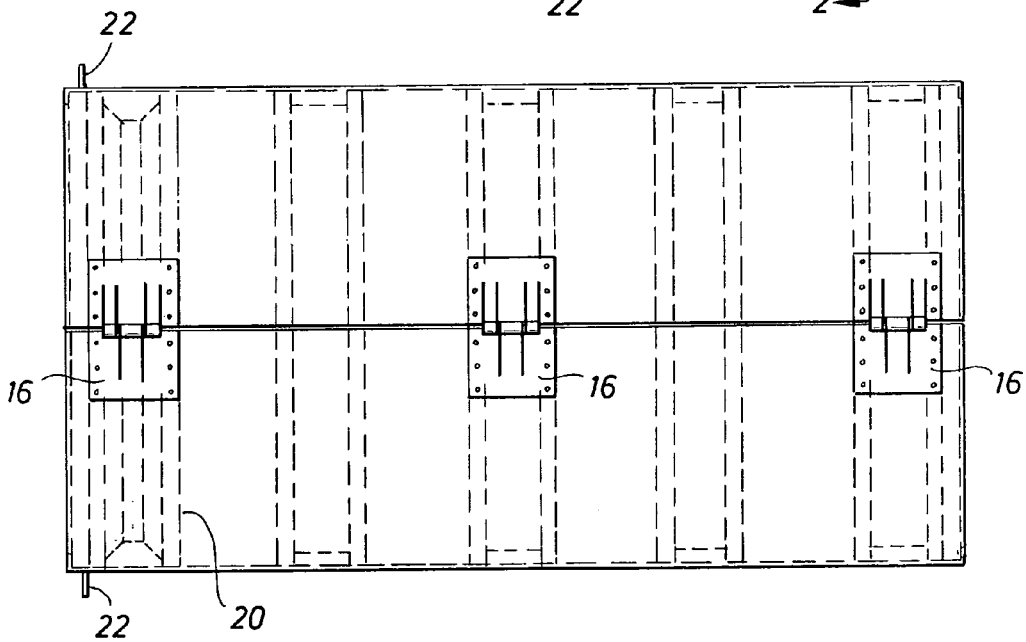
FIG. 2 is a side elevational view of the sleeve of FIG. 1, taken at line 2—2 in FIG. 1.
Figure 3:
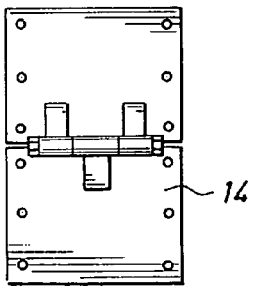
FIG. 3 is side elevational view of a hinge of FIG. 1.
Figure 4:
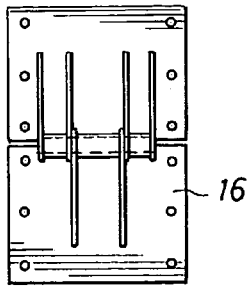
FIG. 4 is a side elevational view of a latch of FIG. 1.
Figure 5:
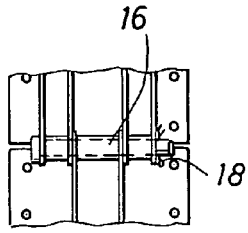
FIG. 5 is a side elevational view of a secured latch.

FIGS. 1 and 2 illustrate a substantially cylindrical sleeve 10 presenting an ultra-smooth surface 12. Here the sleeve is a clam-shell design formed of fiberglass with a gel-coat presenting ultra-smooth surface 12. Opposing sides of the clam-shell are secured with hinges 14 and connectors such as latches 16 which may be secured with a hairpin 18 in one embodiment of the present invention. See also FIGS. 3–4. In FIG. 5, a hinge 16 is shown as secured by pin 18 and retaining ring 19. Lifting provisions may be conveniently provided with lifting eyes 22. Ribs 20 provide some strength to the sleeve 10 and may be formed to axially secure the sleeve about riser sections.

Figure 6:
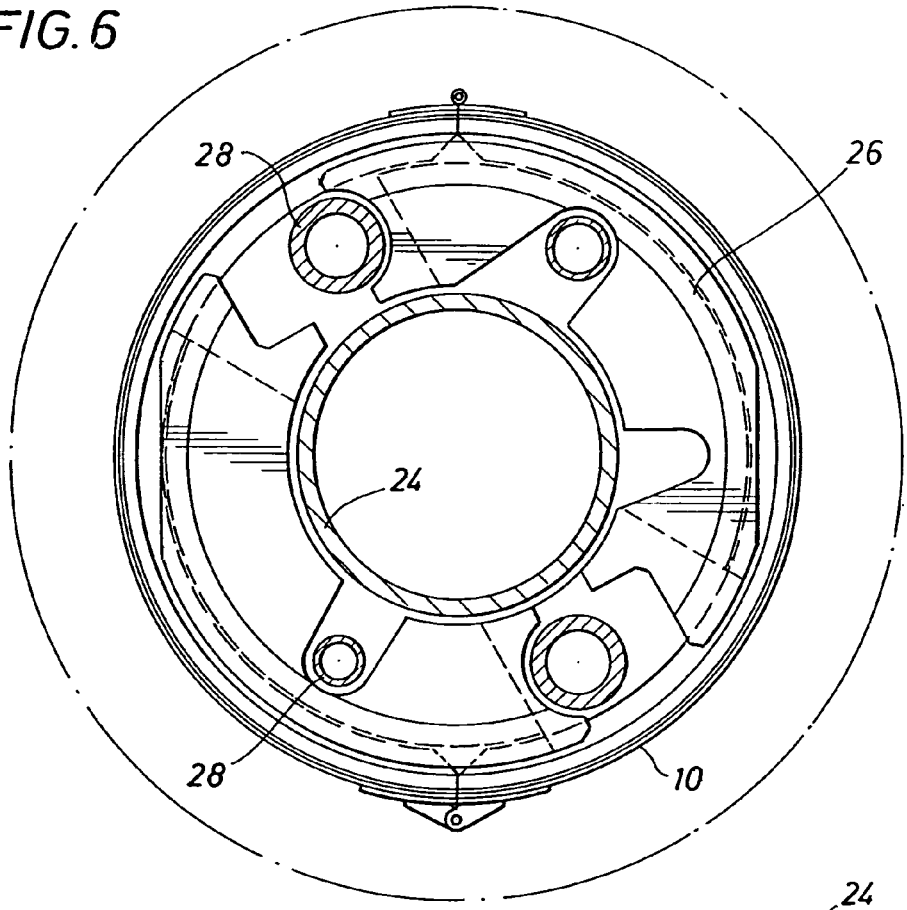
FIG. 6 is a top elevational view of an installed sleeve.

FIG. 6 illustrates sleeve 10 secured about axially cross sectioned drilling riser 24. A dotted outline also illustrates the diameter of the rotary on the offshore platform. Even though the sleeve is configured to encircle a drilling riser 24, its buoyancy modules 26, and attendant control lines 28, it remains sufficiently narrow to pass through the rotary so that installation and removal can be accomplished above the rotary.

Figure 7:
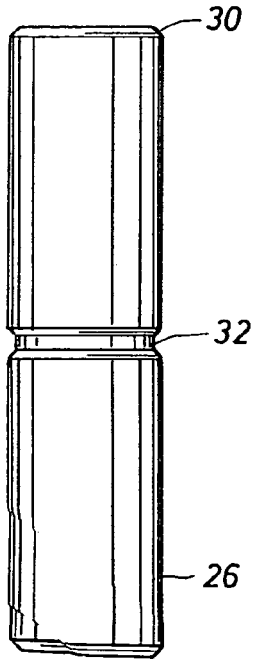
FIG. 7 is a side elevational view of a drilling riser.
Figure 8:
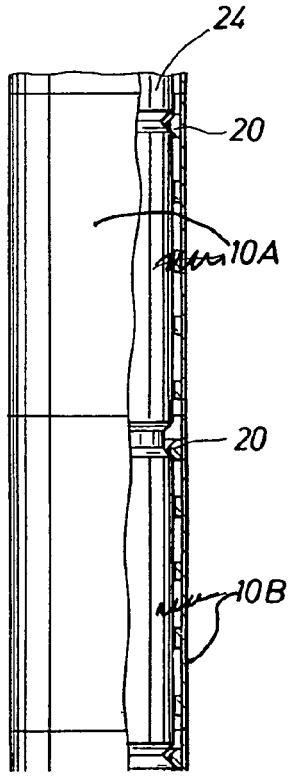
FIG. 8 is a side elevational view of a sleeve installed on a drilling riser.

In this embodiment, it is desired for sleeves 10 to have a substantially shorter length than that of buoyancy module 26 and an additional groove 32 is formed in the outer circumference of the buoyancy module. See FIG. 7. Ribs 20 on the inside of the sleeve sections engage the top 30 of the buoyancy module or the groove, respectively. See sleeve sections 10A and 10B in FIG. 8.

Figure 10:
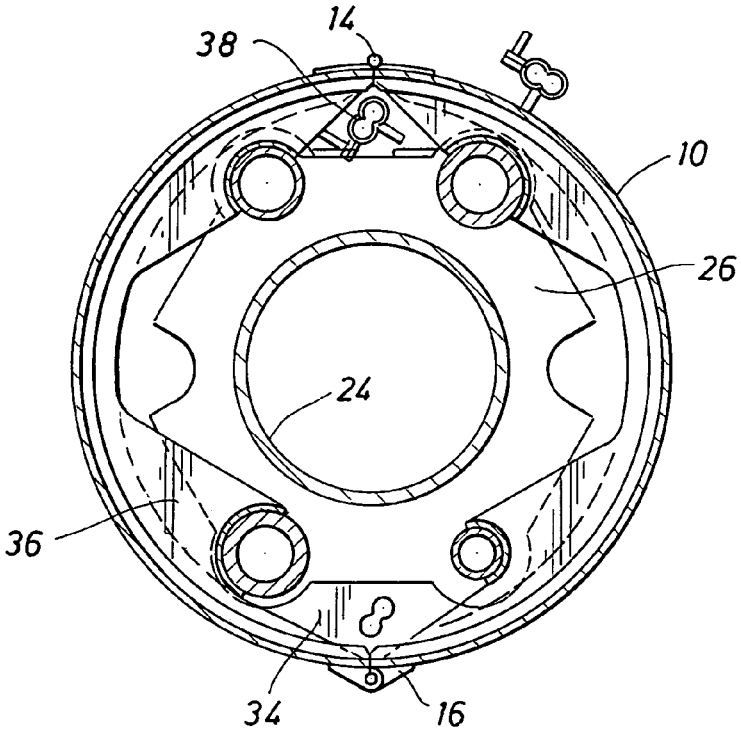
FIG. 10 is a cross sectional top view of the sleeve of FIG. 9 now installed about a drilling riser.
Figure 9:
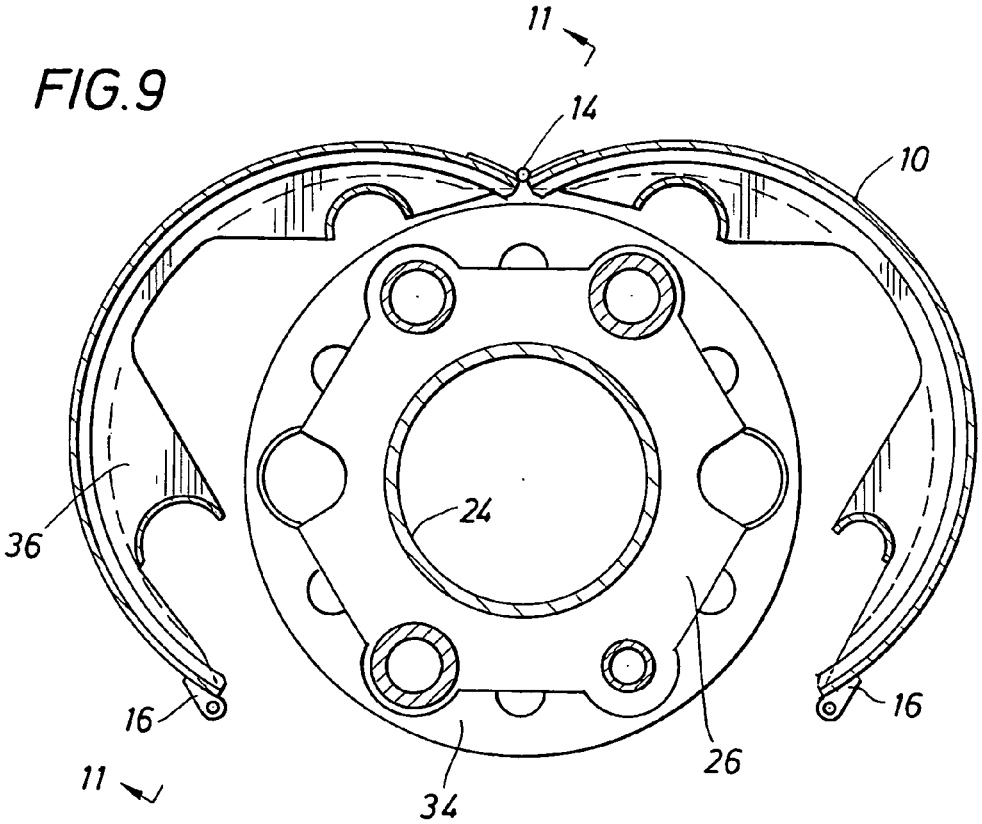
FIG. 9 is a cross sectional top view of a sleeve being installed a bout a riser.
Figure 11:
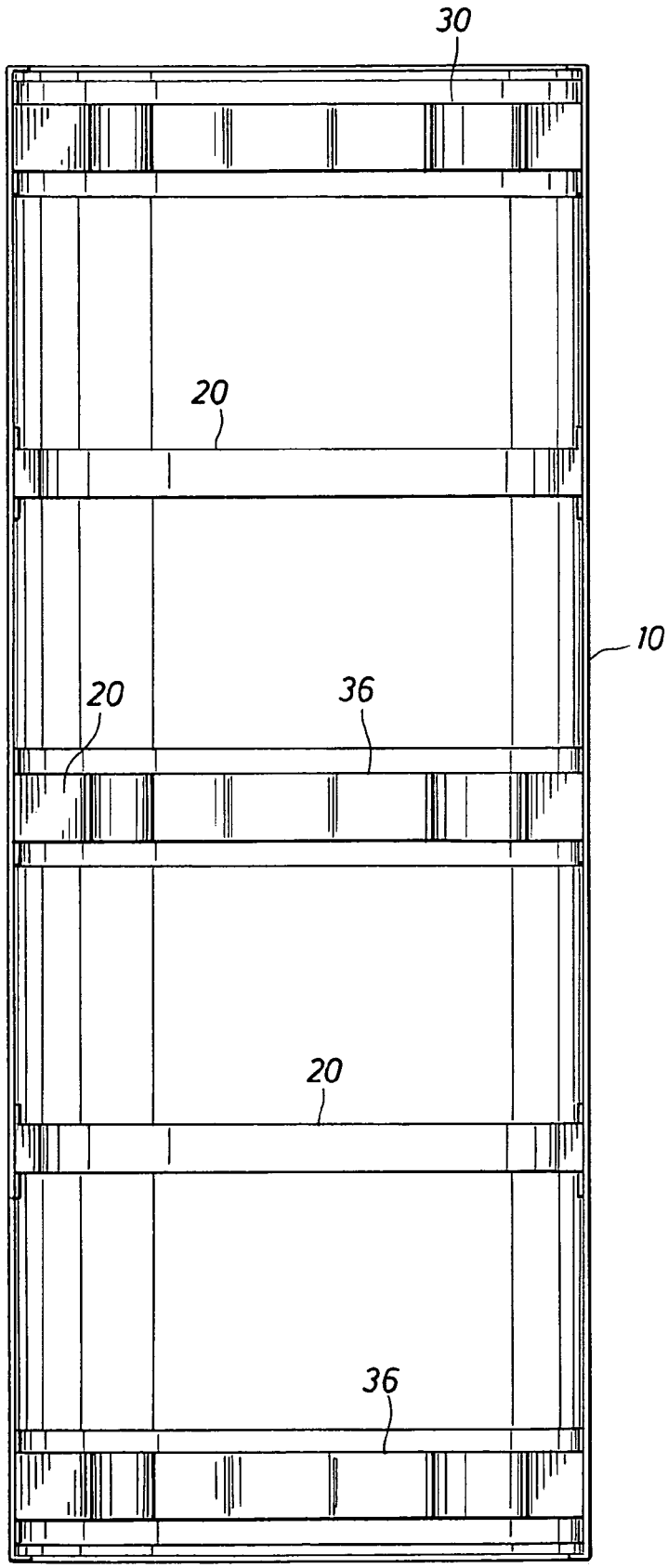
FIG. 11 is a cross sectional side view taken at line 11—11 in FIG. 9 (from which the riser, centralizers and control lines have been removed for simplification)

FIGS. 10–11 illustrate another embodiment. Here drilling riser 24 is afforded buoyancy modules 26 at intervals and the control lines 28 are surround intermittently with riser centralizers 34. Note how ribs 20 are provided seats 36 to form around the control lines/buoyancy modules and to rest on centralizers 34. FIGS. 9 and 10 illustrate sleeve installation with the clam-shell capture of the drilling riser. Note also that the standoff of mux line 38 folds to a position within sleeve 10.

Figure 12:
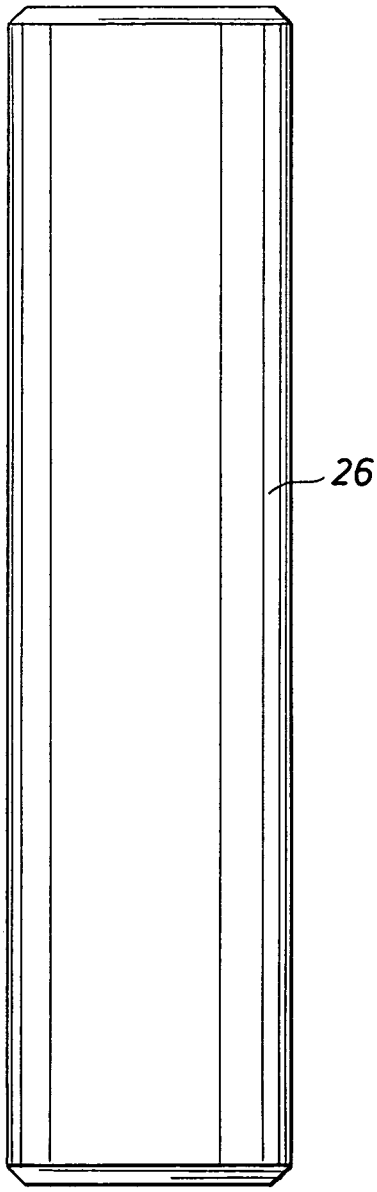
FIG. 12 is a side elevational view of a drilling riser section.
Figure 13:
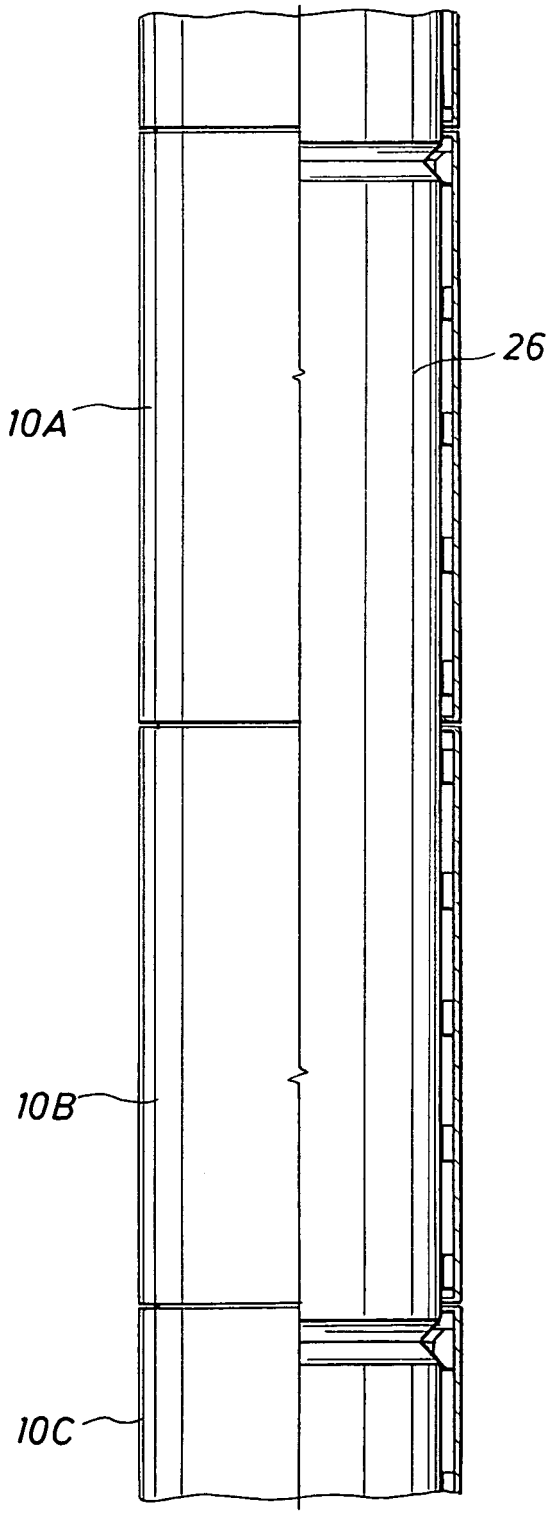
FIG. 13 is a side elevational view of an alternate embodiment of a sleeve installed about the riser.

FIGS. 12–13 illustrate another here for using half length sleeve sections 10 with full length buoyancy modules 26. In this instance two types of sleeve sections are used, hanging sleeve 10A and stacking sleeve 10B. The hanging sleeve engages to the top surface of the buoyancy module and any centralizer presented there. The stacking sleeve 10B can be configured to engage to the bottom of hanging sleeve 10A or to rest on top of the next lower hanging sleeve 10C and the ribs are configured accordingly. See FIG. 13.

Figure 14:
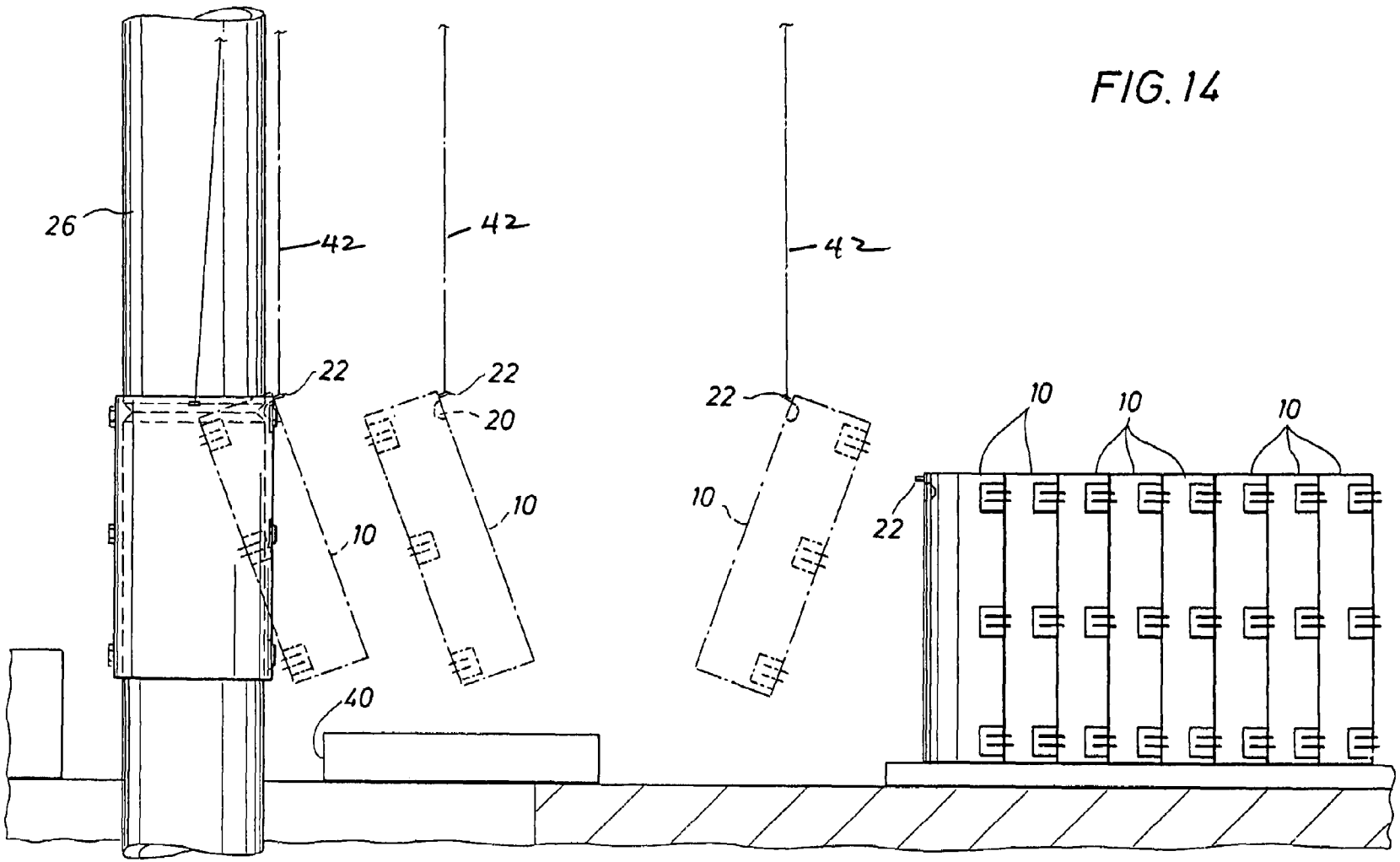
FIG. 14 is a side elevatational "movie" view of sleeve handling procedures.

FIG. 14 illustrates one option for sleeve handling. It is a "movie" of running sleeves 10 on cables 42 operated by a crane (not shown). The assembly/disassembly operation (see FIGS. 9 and 10) is conducted above rotary opening 40. This greatly simplifies handling and storage of the sleeve sections.

Another possibility facilitated by overall dimensions that can pass through the rotary is installing the sleeve sections on an installed drilling riser. In this embodiment the sleeve is near neutrally buoyant, made up above the rotary, lowered to the ocean surface and released. The ribs, if any, are configured to allow easy sliding of the sleeve and an array of sleeves is stacked, one on another, as concentrically symmetrical sleeves slide along the drilling riser.

Alternatively, the sleeve sections may be installed below the rotary, whether installed at the time of riser deployment or installed later.

The illustrated examples use gel-coated fiberglass. However, the ultra-smooth surface could be provided by sleeves made of copper (when marine growth inhibition is required), carbon fiber, rubber, or any sufficiently smooth thermoplastic, metal alloy, or other material. The smooth surface may even be obtained by the surface finish on the outside of the cylindrical element or maintained by a ablative paint or other coating applied to the surface of the element.

If sleeves are used to present the substantially cylindrical ultra-smooth surface, there are a number of alternatives to construct and attach or install the sleeves. For instance, the sleeve can be clam-shelled around the cylindrical element using hinges and alternative latching mechanisms such as snaps, bolts, or other fasteners. Alternatively, the sleeves can be made with a continuous circumference and slid over a cylindrical element. Or there are other alternatives for constructing a sleeve from one or more sections. For instance, the sleeve need not be constructed of halves, each covering an approximately equal amount of the circumference. A C sleeve (a sleeve that covers more than 180 degrees of the circumference but less than 360 degrees of the circumference) can be made with the rest of the circumference optionally enclosed by a second piece that completes the circumference. The C shaped sleeve can be clam-shelled around the cylindrical element using hinges and a latching mechanism, or can be slid over the structure. Further, sleeves, or sleeve sections, covering all or part of the circumference, can be held in place using hardware that is attached to the cylindrical element itself. This hardware can include latches, receptacles for bolts, pins, rivets, screws, or other fasteners. Or, a sleeve that consists of two or more parts, which make up the circumference, can be made such that the parts are held together by straps or banding materials. This includes the possibility of providing grooves in the cylindrical element to allow for strapping materials. Further, the sleeves can be pre-installed, they can be installed on the cylindrical element during its installation (e.g. while running a drilling riser); or they can be installed after the cylindrical element has already been installed (a post-installation).

While there are many ways to provide it, a critical aspect is the ultra-smooth surface. The drag coefficient for flow past a cylinder sharply decreases as the Reynolds number is increased beyond about 200,000 (called the "critical" Reynolds number range) and then slowly recovers (called the "supercritical" Reynolds number range). While it was recognized that surface roughness can affect the Reynolds number at which this "dip" occurs and can add to the drag coefficient, conventional wisdom held that cylindrical elements should experience substantial VIV accompanied by fairly large drag at critical and supercritical Reynolds number ranges.

But, surprisingly, it was discovered that a very smooth cylinder would not experience VIV in this Reynolds number range, and furthermore this cylinder would experience very low drag. Further, an "Ultra-smooth" sleeve can be effective in Reynolds number ranges from about 200,000 to over 1,500,000, perhaps more. In fact, benefits begin to be seen m the VIV and drag at a Reynolds number of about 100,000.

This relationship of VIV and drag as a function of the level of surface roughness has been found to be quantifiable in a dimensionless roughness parameter, K/D, where:

K is the roughness density and is defined as the average peak to trough distance of the surface roughness (e.g., as measured using confocal scanning with an electron microscope); and D is the effective outside diameter of the cylinder element, including any sleeve or coating.

Substantial reduction in VIV can be observed where KID is less than about $1.0\times10^{-4}$ and is most pronounced at about $1.0\times10^{-5}$ or less for fairly uniform roughness densities. Similar results may be achieved where the roughness density decreases, even though the overall K/D ratio may increase.

Figure 15:
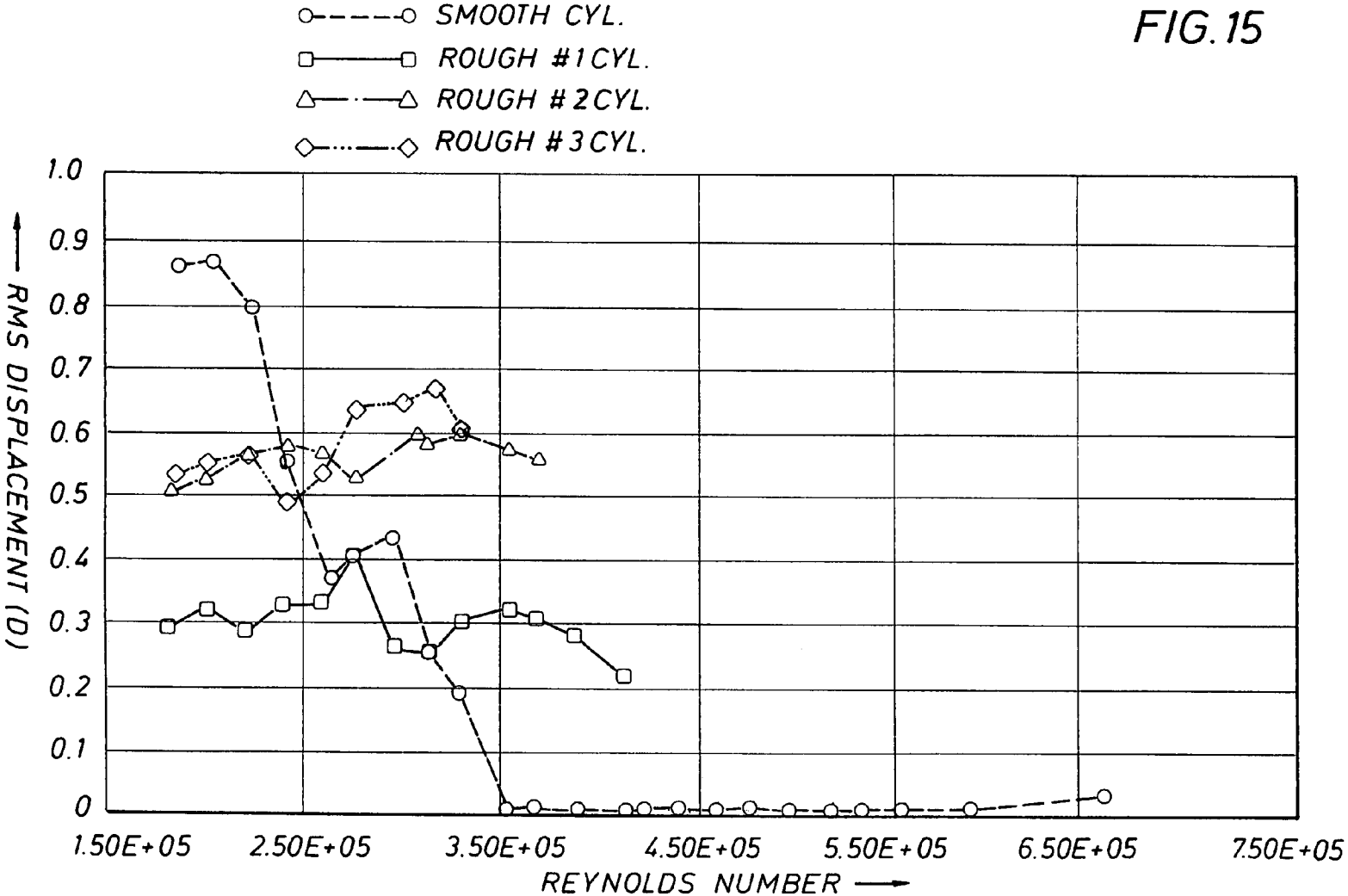
FIG. 15 is a graph of VIV as a function of Reynolds Number.
Figure 16:
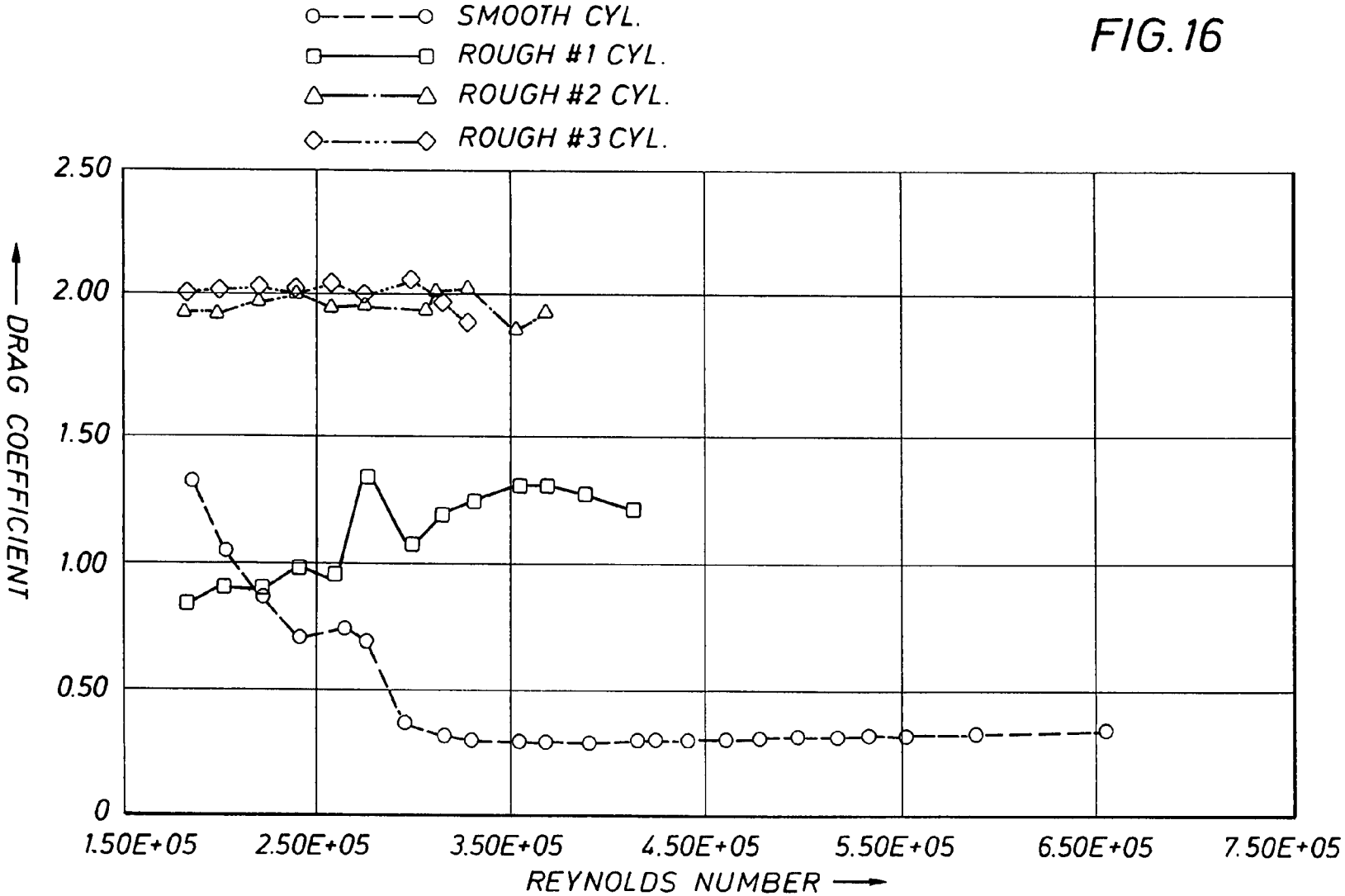
FIG. 16 is a graph of drag coefficient as a function of Reynolds Number.

FIGS. 15–16 illustrate test results demonstrating the surprising practicality and effectiveness of ultra-smooth surfaces. These tests were conducted in a tow tank environment with the marine element towed to develop relative motion between the test subject and the water. FIG. 15 illustrates transverse root-mean-square (RMS) displacement as a function of the Reynolds number for an ultra-smooth cylinder and for relatively rough cylinders representing marine elements. FIG. 16 illustrates drag coefficient as a function of Reynolds number for the same samples. The dimensionless roughness parameter K/D for these samples were:

| | |
|---|---|
| ultra-smooth | $5.1 \times 10^{-5}$ |
| Rough #1 | $1.9 \times 10^{-4}$ |
| Rough #2 | $2.5 \times 10^{-3}$ |
| Rough #3 | $5.8 \times 10^{-3}$ |

Improvement to both suppression of VIV excitement and drag was observed and very pronounced at $K/D=5.1\times10^{-5}$.

It should be appreciated that this improvement in the ability to control both drag and VIV beneficially impacts offshore operations. For instance, in drilling riser applications, this could reduce or eliminate down time due to ocean currents, including loop current phenomena. On production risers, enhanced drag and VIV reduction can allow closer spacing of risers without interference problems. Further, this could impact the design of TLPs or spars in high current areas by eliminating, or reducing, the need for more expensive methods and devices.

Although the illustrative examples are principally drilling risers, those having ordinary skill in the art and the benefit of this disclosure could apply this invention to any number of cylindrical members including, but not limited to, subsea pipelines; production, import and export risers (catenary or not); tendons for tension leg platforms; legs for traditional fixed and for compliant platforms; space-frame members for platforms; cables; umbilicals; other mooring elements for deepwater platforms; and hull and/or column structures for tension leg platforms (TLPs) or for spar type structures.

Other modifications, changes, and substitutions are also intended in the forgoing disclosure. Further, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A method of reducing drag and vortex induced vibration in a substantially cylindrical element comprising providing a substantially cylindrical marine element having an ultra-smooth surface about the cylindrical element having an average K/D ratio of less than $8.0\times10^{-5}$ where:

K is an average measure surface peak to trough distance and

D is an effective outside diameter of the cylindrical element.

2. The method of claim 1, wherein the ultra-smooth surface comprises two or more parts which are attached about the substantially cylindrical marine element.

3. The method of claim 1, wherein the ultra-smooth surface comprises a K/D ratio $5.1\times10^{-5}$ or less.

4. A method of reducing drag and vortex induced vibration about a substantially cylindrical marine element comprising providing an ultra-smooth surface coating about the cylindrical element having an average K/D ratio of less than $8.0\times10^{-5}$ where:

K is an average measured surface peak to trough peak distance; and

D is an effective outside diameter of the cylindrical element including the coating.

5. The method of claim 4, wherein the substantially cylindrical marine element comprises two or more parts.

6. The method of claim 4, wherein the substantially cylindrical marine element comprises a high strength material selected from the group consisting of fiberglass, copper, carbon fiber, and metal alloys.

7. The method of claim 4, wherein the ultra-smooth surface coating comprises a K/D ratio $5.1\times10^{-5}$ or less.

8. A method of reducing drag and vortex induced vibration about a substantially cylindrical marine element comprising providing an ultra-smooth surface on a substantially cylindrical sleeve about the cylindrical element, the sleeve having an average K/D ratio of less than $8.0\times10^{-5}$ where:

K is an average measured surface peak to trough peak distance; and

D is an effective outside diameter of the cylindrical element, including the sleeve.

9. The method of claim 8, wherein the substantially cylindrical sleeve comprises two or more parts which are attached about the substantially cylindrical marine element.

10. The method of claim 8, wherein the substantially cylindrical sleeve comprises a high strength material selected from the group consisting of fiberglass, copper, carbon fiber, and metal alloys.

11. The method of claim 8, wherein the ultra-smooth surface comprises a K/D ratio $5.1\times10^{-5}$ or less.

12. A system for reducing drag and vortex induced vibration, comprising:

a substantially cylindrical marine element having an ultra-smooth effective surface with an average K/D roughness parameter of less than $8.0\times10^{-5}$, where:

K is an average measured surface peak to trough peak distance; and

D is an effective outside diameter of the cylindrical element.

13. The system of claim 12, wherein the ultra-smooth surface comprises two or more parts which are attached about the substantially cylindrical marine element.

14. The system of claim 12, wherein the ultra-smooth surface comprises a KID ratio $5.1\times10^{-5}$ or less.

15. A system for reducing drag and vortex induced vibration comprising:

a substantially cylindrical marine element having an ultra-smooth coating material with an average K/D roughness parameter of less than $8.0\times10^{-5}$ where:

K is an average measured surface peak to trough peak distance; and

D is an effective outside diameter of the cylindrical element including the coating.

16. The system of claim 15, wherein the substantially cylindrical marine element comprises two or more parts.

17. The system of claim 15, wherein the substantially cylindrical marine element comprises a high strength material selected from the group consisting of fiberglass, copper, carbon fiber, and metal alloys.

18. The system of claim 15, wherein the ultra-smooth coating material comprises a K/D ratio $5.1\times10^{-5}$ or less.

19. A system for reducing drag and vortex induced vibration comprising:

a substantially cylindrical marine element having an ultra-smooth substantially cylindrical sleeve surrounding the marine element with an average K/D roughness ratio of less than $8.0\times10^{-5}$ where:

K is an average measured surface peak to trough peak distance; and

D is an effective outside diameter of the cylindrical element including the cylindrical sleeve.

20. The system of claim 19, wherein the substantially cylindrical sleeve comprises two or more parts which are attached about the substantially cylindrical marine element.

21. The system of claim 19, wherein the substantially cylindrical sleeve comprises a high strength material selected from the group consisting of fiberglass, copper, carbon fiber, and metal alloys.

22. The system of claim 19, wherein the substantially cylindrical sleeve comprises a K/D ratio $5.1\times10^{-5}$ or less.

* * * * *